US007956837B2

(12) United States Patent
Wang et al.

(10) Patent No.: US 7,956,837 B2
(45) Date of Patent: Jun. 7, 2011

(54) METHOD FOR ELIMINATING SHADOW AROUND SUPPORT PIN OF LED BACKLIGHT

(75) Inventors: Te-Mei Wang, Hsin-Chu (TW); Po-Jen Tsai, Tao-Yuan (TW)

(73) Assignee: Au Optronics Corporation, Hsinchu (TW)

( * ) Notice: Subject to any disclaimer, the term of this patent is extended or adjusted under 35 U.S.C. 154(b) by 1345 days.

(21) Appl. No.: 11/496,619

(22) Filed: Aug. 1, 2006

(65) Prior Publication Data

US 2007/0262947 A1 Nov. 15, 2007

(30) Foreign Application Priority Data

May 12, 2006 (TW) ..... 95116956 A

(51) Int. Cl.
*G09G 3/36* (2006.01)

(52) U.S. Cl. ..... 345/102; 345/55; 345/204; 345/690

(58) Field of Classification Search ..... 345/102–103, 345/55, 204
See application file for complete search history.

(56) References Cited

U.S. PATENT DOCUMENTS

2004/0125995 A1* 7/2004 Jeong et al. ..... 382/128
2005/0231087 A1* 10/2005 Huang et al. ..... 313/292
2007/0115670 A1* 5/2007 Roberts et al. ..... 362/367

* cited by examiner

*Primary Examiner* — Richard Hjerpe
*Assistant Examiner* — Leonid Shapiro
(74) *Attorney, Agent, or Firm* — Scott, Uxa, Buyan & Mullins, LLP

(57) ABSTRACT

A method for eliminating shadow around a support pin of an LED backlight is provided. The method includes determining a luminance value for the plurality of LEDs according to a gray level distribution of pixels around the support pin, and setting the plurality of LEDs to the luminance value. The method may also include adjusting gray levels of related pixels according to the luminance profile of pixels around the support pin.

22 Claims, 3 Drawing Sheets

50

| | | | | |
|---|---|---|---|---|
| 255 | 255 | 255 | 255 | 255 |
| 255 | 255 | 255 | 255 | 255 |
| 255 | 255 | 255 | 255 | 255 |
| 255 | 255 | 255 | 255 | 255 |
| 255 | 255 | 255 | 255 | 255 |

52

| | | | | |
|---|---|---|---|---|
| 250 | 252 | 254 | 252 | 250 |
| 253 | 251 | 255 | 251 | 253 |
| 254 | 255 | 248 | 255 | 254 |
| 253 | 251 | 255 | 251 | 253 |
| 250 | 252 | 254 | 252 | 250 |

54

| | | | | |
|---|---|---|---|---|
| -2 | -4 | -6 | -4 | -2 |
| -5 | -3 | -7 | -3 | -5 |
| -6 | -7 | 0 | -7 | -6 |
| -5 | -3 | -7 | -3 | -5 |
| -2 | -4 | -6 | -4 | -2 |

FIG. 5A

50

| | | | | |
|---|---|---|---|---|
| 255 | 255 | 255 | 255 | 255 |
| 255 | 255 | 255 | 255 | 255 |
| 255 | 255 | 255 | 255 | 255 |
| 255 | 255 | 255 | 255 | 255 |
| 255 | 255 | 255 | 255 | 255 |

+

54

| | | | | |
|---|---|---|---|---|
| -2 | -4 | -6 | -4 | -2 |
| -5 | -3 | -7 | -3 | -5 |
| -6 | -7 | 0 | -7 | -6 |
| -5 | -3 | -7 | -3 | -5 |
| -2 | -4 | -6 | -4 | -2 |

=

56

| | | | | |
|---|---|---|---|---|
| 253 | 251 | 249 | 251 | 253 |
| 250 | 252 | 248 | 252 | 250 |
| 249 | 248 | 255 | 248 | 249 |
| 250 | 252 | 248 | 252 | 250 |
| 253 | 251 | 249 | 251 | 253 |

FIG. 5B

METHOD FOR ELIMINATING SHADOW AROUND SUPPORT PIN OF LED BACKLIGHT

BACKGROUND OF THE INVENTION

1. Field of the Invention

The present invention relates to a light emitting diode (LED) backlight module and a method for eliminating shadow noise, and more particularly, to a backlight module with a support pin and a method for eliminating shadow around the support pin of an LED backlight.

2. Description of the Related Art

Currently, liquid crystal display (LCD) backlights in common use include cold cathode fluorescent lamps (CCFLs) and LEDs. It has a great opportunity for the LED type to prevail in the competition due to the advantages in environmental protection and color brightness. Especially when applied in the area of high contrast LCD, the high brightness of LED is far more desirable than that of CCFL.

In conventional LCDs, either with CCFLs or LED backlights, the whole backlight modules are controlled collectively instead of locally or independently. Additionally, in conventional LCDs, optical films on a backlight module usually have superior light diffusion quality to attain a uniform backlight behavior. In high contrast LCD application, however, to achieve a better contrast (beyond 10000:1, for example), the methodology about backlight control and the criteria for selecting optical film may be totally different. For example, luminance of an individual LED is usually controlled independently, and the criteria for a feasible optical film tends to require better local brightness instead of global uniformity.

An LCD device with LED backlight generally needs to install several support pins in between the backlight and the optical plate, so as to keep a uniform distance all over therebetween. In such a high contrast large scale LCD, it is inevitable that some shadow effect may arise on the panel area around a support pin as a result of random light refraction and reflection which in turn is due to non-uniform luminance of LEDs surrounding the support pin as well as the shade of the support pin itself. Independent control of backlight LEDs and locally concentrative brightness of optical films should also account for the undesirable noises produced in the shadow effect.

FIG. 1 illustrates the relative location about a typical support pin and the surrounding LEDs within a backlight module under an optical plate. Specifically, what shown in FIG. 1 includes a support pin 10, a plurality of LEDs 20, and an optical plate 90. As shown in FIG. 1, the support pin 10 is located among four backlighting LEDs 20 so as to keep a uniform distance between the optical plate 90 and the backlight therebelow. Obvious shadow noise will appear on the panel area near the support pin 10 as mentioned above. The shadow noise in turn downgrades the quality of images displayed nearby the support pin 10.

SUMMARY OF THE INVENTION

In view of the foregoing, there is a need to provide a method to eliminate the shadow around a support pin of an LED backlight so as to ensure the overall image quality.

Accordingly, it is an object of the present invention to provide a method for eliminating the shadow around a support pin of an LED backlight in a flat display, so as to keep the fidelity of images displayed around the support pin.

It is another object of the present invention to provide an LED backlight module, which is configured to eliminate the shadow around a support pin of the LED backlight, so as to keep the fidelity of any image displayed around the support pin.

According to foregoing objects, the present invention combines luminance control toward the LEDs around a support pin and proprietary image processing steps to provide a method for eliminating shadow around a support pin of an LED backlight in a flat display. The method generally includes determining a luminance value of the plurality of LEDs according to a gray level distribution of a plurality of pixels around the support pin and setting the plurality of LEDs to a corresponding luminance in accordance with the luminance value of the plurality of LEDs, so as to eliminate shadow around the support pin. The method may further include adjusting gray levels of related pixels according to the luminance profile of pixels around the support pin.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures, wherein:

FIG. 5A illustrates the method to generate the inverse mask for a specific gray level in accordance with the present invention; and FIG. 5B illustrates the method to correct the pixels located around the LEDs surrounding a support pin with an inverse mask in accordance with the present invention.

DETAILED DESCRIPTION OF THE INVENTION

Preferred embodiments in accordance with the present invention will now be described in detail with the accompanying drawings.

Figure 1:
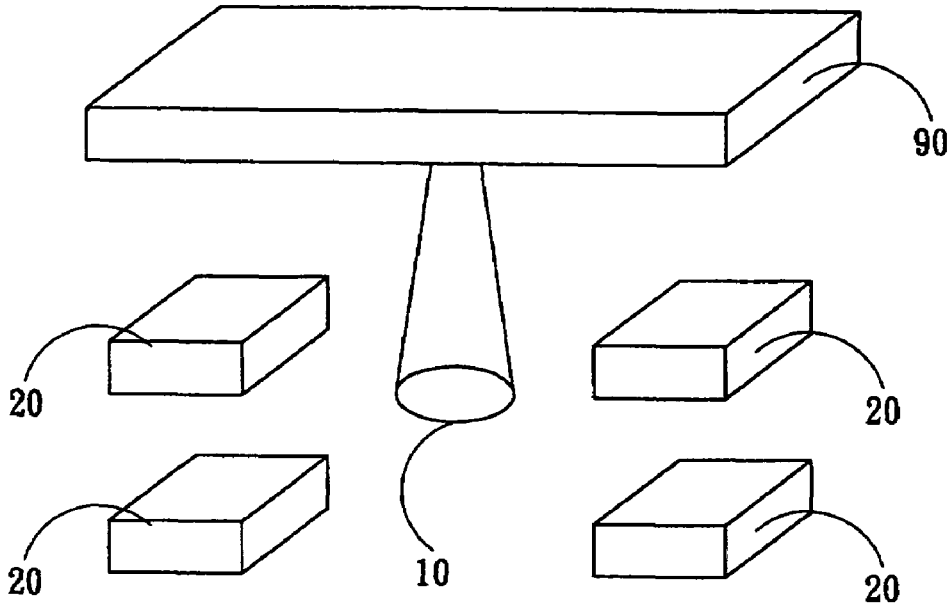
FIG. 1(Prior Art)
FIG. 1 illustrates the relative location about a typical support pin and the surrounding LEDs within a backlight module under an optical plate.
Figure 2:
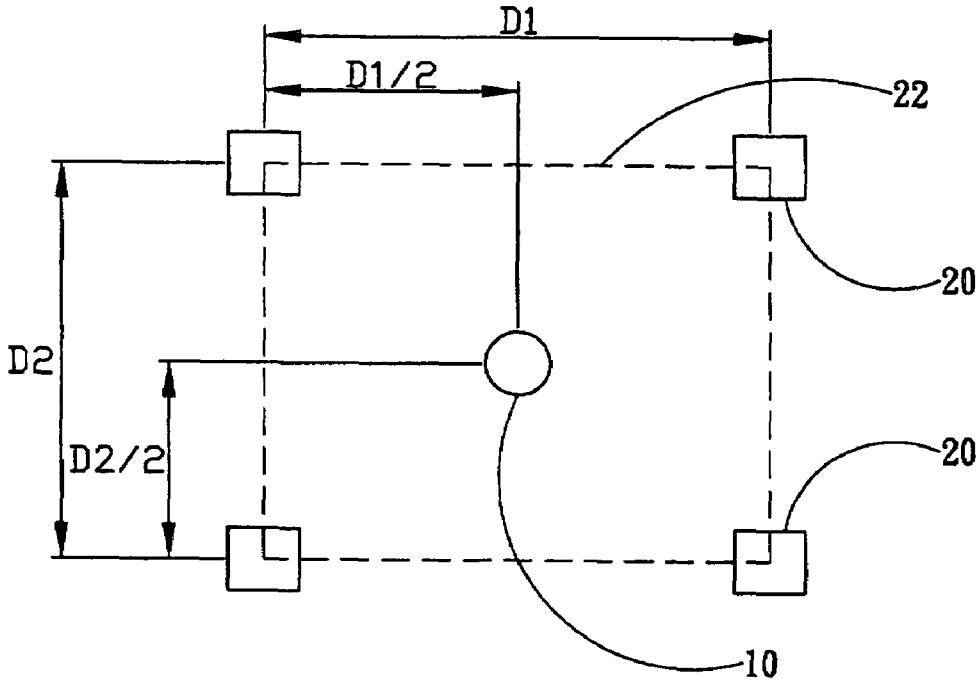
FIG. 2 illustrates a concept to locate a support pin at the center of the surrounding LEDs.

FIG. 2 illustrates a concept to locate a support pin at the center of the surrounding LEDs in accordance with the present invention. It contains a support pin 10 and a plurality of LEDs 20. Also shown in FIG. 2 is an imaginary rectangle 22 formed by the plurality of LEDs 20. As noted in FIG. 2, the support pin 10 is located among the ambient LEDs 20. Assume the length and width of the imaginary rectangle 22 are D1 and D2, respectively. The projection of the support pin 10 on the imaginary rectangle 22 should be located within the imaginary rectangle 22. Preferably, the geometric center of the projection of support pin 10 is located at the center point of the imaginary rectangle 22. The distance between the center point and adjacent sides of the imaginary rectangle 22 are D1/2 and D2/2 respectively as shown in FIG. 2. For example, if the geometric shape of the projection of support pin 10 is a circle, the circle should be located within the imaginary rectangle 22 and the center of the circle is preferably superimposed with the geometric center of the imaginary rectangle 22. In other words, the circle is preferably located at the center of the imaginary rectangle 22. However, the geometric shape of the projection of support pin 10 is not necessarily a circle. Alternatively, it may be a square, a rectangle, a symmetric polygon, or any other geometric shape approximately symmetric to a center point.

A method in accordance with a preferred embodiment of the present invention includes step (a) and step (b). Step (a) includes determining a luminance value for the plurality of LEDs according to a gray level distribution of pixels around a support pin. Step (b) includes setting the plurality of LEDs to the luminance value determined in step (a).

Also referring to FIG. 2, Step (a) and step (b) of the preferred embodiment set all LEDs 20 to a uniform luminance determined by a gray level distribution of pixels located around the support pin 10. Practically, the luminance values of all backlight LEDs (including LEDs 20 shown in FIG. 2) are determined according to actual gray level distribution of related pixels. In other words, the actual gray level distribution of pixels around the support pin 10 can be transformed to a corresponding luminance for that LED 20 through a specific conversion $f^1$. Luminance values of pixels are generally represented by digitized gray levels. Accordingly, $f^1$ is a function converting gray levels to a luminance value for any specific LED 20. The detail of $f^1$ will not be further described since it depends on requirements of respective flat panel display.

Figure 3:
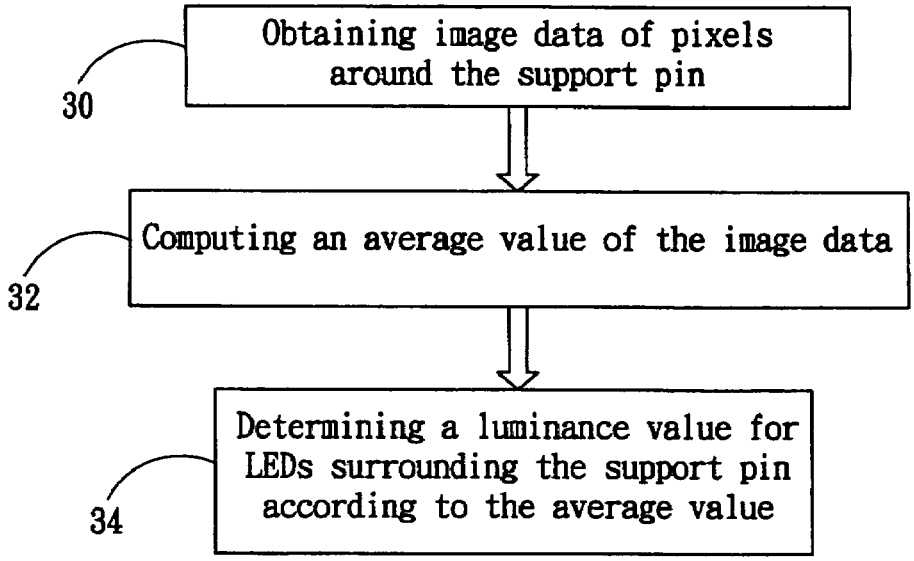
FIG. 3 shows a flow to control the luminance of the LEDs surrounding a support pin in accordance with a preferred embodiment of the present invention.

Step (a) of the preferred embodiment can be further divided as shown in the flow of FIG. 3. The exemplary flow shown in FIG. 3 comprises steps 30 through 34, in which step 30 includes obtaining image data of pixels around the support pin; step 32 includes computing an average value of the image data obtained in step 30; and step 34 includes determining a luminance value for LEDs surrounding the support pin according to the average value obtained in step 32. The image data of pixels in step 30 essentially means gray levels of pixels. Particularly, if there are n pixels around the support pin and the image data obtained in step 30 includes n gray levels, say L1,L2, . . . ,Ln, then step 32 may calculate (L1+L2+ . . . +Ln)/n to get the average value of the image data. Step 34 may then determine a luminance value of LEDs surrounding the support pin by aforementioned function $f^1$ with the average value from step 32 as an input.

In another embodiment in accordance with the present invention, step 32 computes a characteristic value for image data obtained in step 30. The characteristic value is then employed in step 34 to determine the luminance value of LEDs surrounding a support pin through aforementioned function $f^1$ with the characteristic value as an input thereto. For example, step 32 may compute a median value of image data obtained in step 30. Alternatively, steps 32 may divide the image data into a plurality of groups according to several threshold values and compute a weighted average value by assigning different weights to different groups. Those skilled in the art will appreciate that although distinct characteristic values such as a median value or various average values can lead to different effects, one can use different methods for computing the characteristic value.

Figure 4:
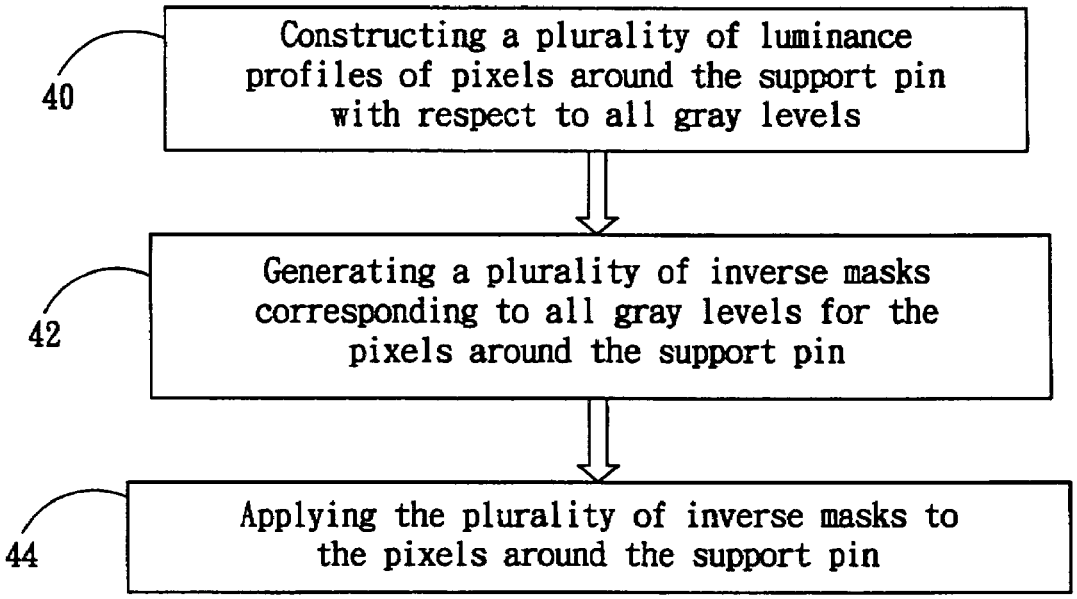
FIG. 4 shows an image processing flow in accordance with a preferred embodiment of the present invention.

The shadow around a support pin of an LED backlight should have been substantially eliminated after step (a) and (b). However, in accordance with the invention, another embodiment will be described to further improve the shadow removing effect by image processing. In addition to step (a) and (b) as described in above embodiments, the present embodiment further includes an image processing step (c) which adjusts gray levels of related pixels according to a luminance profile of pixels around the support pin. The image processing step (c) may be further divided to three steps as shown in FIG. 4. The exemplary flow shown in FIG. 4 comprises steps 40 through 44, in which step 40 includes constructing a plurality of luminance profiles of pixels around the support pin with respect to all gray levels; step 42 includes generating a plurality of inverse masks corresponding to all gray levels for the pixels around the support pin; and step 44 includes applying the plurality of inverse masks to the pixels around the support pin.

Constructing a plurality of luminance profiles in step 40 can be carried out by using any image capturing device such as a digital still camera (DSC). Moreover, it should be performed under the condition that all LEDs surrounding the support pin are controlled to a uniform luminance. To make a luminance profile for a gray level GL, for example, it may display a test picture with all pixels having gray level GL on a test panel, and then capture an image of the test picture by a DSC. The gray level distribution of the captured image (or the measured image) is a luminance profile for the gray level GL. There are various ways to construct the luminance profiles for all gray levels in step 40. An obvious way is to measure all luminance profiles corresponding to all gray levels independently and respectively. Assuming the possible gray levels vary from 0 to 255 (total 256 levels), there will be 255 luminance profiles generated (the trivial level 0 is discarded). Alternatively, the luminance profile corresponding to the maximum gray level (e.g. 255) can be measured first, and then remaining luminance profiles are calculated by methods such as proportional scaling. Another variation is to measure a plurality of luminance profiles corresponding to representative gray levels, and then interpolate remaining luminance profiles. If the possible gray levels vary from 0 to 255, then there will be totally 255 luminance profiles generated in step 40 as mentioned above.

FIG. 5A illustrates how to generate the inverse masks in step 42. The example is about the case for gray level 255, the rest may be deduced by analogy. FIG. 5A includes an original gray level matrix 50, a measured image gray level matrix, and an inverse mask 54. The dimensions of matrices illustrated are all five by five, which means only 25 pixels are considered. Although the exact number of pixels involved may depend on different cases, the method to generate corresponding inverse mask is similar. The number in each matrix cell may represent a gray level of pixel in corresponding location or a result of an arithmetic operation between corresponding matrix cells. Since this example is about the case for gray level 255, cells of the original gray level matrix 50 all contain values of 255, which means ideal luminance values for an image having all pixels with identical gray level 255. The measured image gray level matrix 52 contains cells with different values equal or slightly less than 255, which represents the gray levels converted from the actual luminance measured for the image around a backlight support pin. Each cell in the inverse mask 54 stores the difference between the minimum cell in the measured image gray level matrix 52 and the corresponding cell thereof As is shown in FIG. 5A, the value of the minimum cell in the measured image gray level matrix 52 is 248. Accordingly, for example, for the cells respectively having values of 248, 251, and 255 in the measured image gray level matrix, the corresponding cells in the inverse mask 54 will respectively contain values of 0 (i.e., 248−248), −3 (i.e., 248−251), and −7 (i.e., 248−255).

In step 44, applying the plurality of inverse masks to the pixels around the support pin means adjusting each pixel of an original image by adding thereto the cell value in corresponding location of the corresponding inverse mask. Each pixel in the area around a support pin is adjusted according to its original gray level and its location. Referring to FIG. 5B, which illustrates the correcting result of the original gray level matrix 50 by the corresponding inverse mask 54. FIG. 5B includes the original gray level matrix 50, the inverse mask 54, and a corrected gray level matrix 56. As is shown in FIG. 5B, the corrected gray level matrix 56 is the sum of the original gray level matrix 50 and the inverse mask 54.

Although only preferred embodiments have been illustrated and described, it will be appreciated that various modifications may be made without departing from the scope of the present invention, which is intended to be limited solely by the appended claims.

What is claimed is:

1. A method for eliminating shadow around at least one support pin of a flat panel display backlight for use in a display having a plurality of pixels, said at least one support pin being located at the center among a plurality of light emitting diodes (LEDs), the method comprising:

(a) determining a luminance value of the plurality of LEDs according to a gray level distribution of the plurality of pixels around the at least one support pin; and (b) setting the plurality of LEDs to a corresponding luminance in accordance with the luminance value of the plurality of LEDs, so as to eliminate shadow around the at least one support pin.

2. The method as claimed in claim 1, wherein step (a) comprises:

(a 1) obtaining said gray level distribution of the plurality of pixels around the at least one support pin;

(a2) computing a characteristic value for the gray level distribution; and (a3) determining said luminance value of the plurality of LEDs according to said characteristic value.

3. The method as claimed in claim 2, wherein said characteristic value is an average value of said gray level distribution.

4. The method as claimed in claim 3, wherein said luminance value is determined by a gray-level-to-luminance conversion function of said average value.

5. The method as claimed in claim 1, wherein step (a) comprises:

(a1) obtaining said gray level distribution of the plurality of pixels around the at least one support pin;

(a2) computing a characteristic value for the gray level distribution; and (a3) determining said luminance value for the plurality of LEDs according to said characteristic value.

6. The method as claimed in claim 5, wherein said characteristic value is an average value of said gray level distribution.

7. The method as claimed in claim 6, wherein said luminance value is determined by a gray-level-to-luminance conversion function of said average value.

8. The method as claimed in claim 1, further comprising:

(c) adjusting gray levels of the plurality of pixels around at least one support pin according to luminance profiles of the plurality of pixels around at least one support pin.

9. The method as claimed in claim 8, wherein step (c) comprises:

(c1) constructing the luminance profiles of the plurality of pixels surrounding at least one support pin with respect to all gray levels;

(c2) generating a plurality of inverse masks corresponding to all gray levels of the plurality pixels around the at least one support pin; and (c3) adjusting gray levels of the pixels by applying the plurality of inverse masks to the pixels around the at least one support pin.

10. The method as claimed in claim 9, wherein step (c1) comprises constructing a luminance profile for the maximum gray level and computing remaining luminance profiles by proportional scaling.

11. The method as claimed in claim 9, wherein step (c1) comprises constructing luminance profiles for a plurality of gray levels and computing remaining luminance profiles by interpolation.

12. A backlight module, comprising:

a plurality of light emitting diodes (LEDs);

at least one support pin located at the center among the plurality of LEDs; and a backlight control element for determining a luminance value for the plurality of LEDs according to a gray level distribution of pixels around the at least one support pin, and setting the plurality of LEDs to a corresponding luminance in accordance with the luminance value of the plurality of LEDs.

13. The backlight module as claimed in claim 12, wherein said backlight control element is configured to:

(a1) obtain said gray level distribution of pixels around the at least one support pin;

(a2) compute a characteristic value for the gray level distribution;

(a3) determine said luminance value for the plurality of LEDs according to said characteristic value; and (a4) set the plurality of LEDs to a corresponding luminance in accordance with said luminance value.

14. The backlight module as claimed in claim 13, wherein said characteristic value is an average value of said gray level distribution.

15. The backlight module as claimed in claim 14, wherein said luminance value is determined by a gray-level-to-luminance conversion function of said average value.

16. The backlight module as claimed in claim 12, wherein said backlight control element is configured to:

(a1) obtain said gray level distribution of pixels located around the at least one support pin;

(a2) compute a characteristic value for the gray level distribution;

(a3) determine said luminance value for the plurality of LEDs according to said characteristic value; and (a4) set the plurality of LEDs to a corresponding luminance in accordance with said luminance value.

17. The backlight module as claimed in claim 16, wherein said characteristic value is an average value of said gray level distribution.

18. The backlight module as claimed in claim 17, wherein said luminance value is determined by a gray-level-to-luminance conversion function of said average value.

19. The backlight module as claimed in claim 12, further comprising:

an image processing element for adjusting gray levels of pixels around the at least one support pin according to a plurality of luminance profiles of the pixels located around the at least one support pin.

20. The backlight module as claimed in claim 19, wherein said image processing element executes a process comprising the steps of:

(c1) constructing the plurality of luminance profiles of pixels around the at least one support pin with respect to all gray levels;

(c2) generating a plurality of inverse masks corresponding to all gray levels for the pixels around the at least one support pin;

(c3) adjusting gray levels of the pixels by applying the plurality of inverse masks to the pixels around the at least one support pin.

21. The backlight module as claimed in claim 20, wherein step (c1) comprises constructing a luminance profile for the maximum gray level and computing remaining luminance profiles by proportional scaling.

22. The backlight module as claimed in claim 20, wherein step (c1) comprises constructing luminance profiles for a plurality of gray levels and computing remaining luminance profiles by interpolation.

* * * * *